US010862201B2

(12) United States Patent
Sato

(10) Patent No.: US 10,862,201 B2
(45) Date of Patent: Dec. 8, 2020

(54) ANTENNA MODULE

(71) Applicant: Molex, LLC, Lisle, IL (US)

(72) Inventor: Shuichi Sato, Yamato (JP)

(73) Assignee: Molex, LLC, Lisle, IL (US)

( * ) Notice: Subject to any disclaimer, the term of this patent is extended or adjusted under 35 U.S.C. 154(b) by 27 days.

(21) Appl. No.: 16/351,546

(22) Filed: Mar. 13, 2019

(65) Prior Publication Data

US 2019/0319348 A1 Oct. 17, 2019

(30) Foreign Application Priority Data

Apr. 13, 2018 (JP) ..... 2018-077703

(51) Int. Cl.

| | |
|---|---|
| ***H01Q 1/38*** | (2006.01) |
| ***H01Q 5/00*** | (2015.01) |
| ***H01Q 9/04*** | (2006.01) |
| *H01Q 1/22* | (2006.01) |

(52) U.S. Cl.

CPC ..... *H01Q 1/38* (2013.01); *H01Q 1/2291* (2013.01)

(58) Field of Classification Search

None

See application file for complete search history.

(56) References Cited

U.S. PATENT DOCUMENTS

| | | | | |
|---|---|---|---|---|
| 5,023,624 A * | 6/1991 | Heckaman | ..... | H01L 23/66 333/247 |
| 6,861,731 B2 * | 3/2005 | Buijsman | ..... | H01L 23/552 257/664 |
| 8,786,060 B2 * | 7/2014 | Yen | ..... | H01L 23/552 257/660 |

FOREIGN PATENT DOCUMENTS

| | | |
|---|---|---|
| JP | 1994-007247 U | 1/1994 |
| JP | 2007-329735 A | 12/2007 |
| JP | 2008-131489 A | 6/2008 |
| JP | 2014-072563 A | 4/2014 |

* cited by examiner

*Primary Examiner* — Anh Q Tran
(74) *Attorney, Agent, or Firm* — Molex, LLC

(57) ABSTRACT

The antenna module comprises a communication circuit for processing a radio signal; a shield member covering the communication circuit; a conductive strip electrically connected with the communication circuit; a dielectric integrated with the shield member and the conductive strip; and an antenna formed on an outer surface of the dielectric and electrically connected with the conductive strip.

9 Claims, 7 Drawing Sheets

91
95
73
72
12
51
11
71
12f
12d
52
53
A
B
74
75
73a
X
Y
Z

Prior art

ANTENNA MODULE

RELATED APPLICATIONS

This application claims priority to Japanese Application No. 2018-077703, filed on Apr. 13, 2018, which is incorporated herein by reference in its entirety.

TECHNICAL FIELD

The present disclosure relates to an antenna module.

BACKGROUND ART

Conventionally, proposed is a technology for placing on a cover having an antenna formed on the upper surface as an antenna module comprising an antenna for transmitting and receiving a radio signal via a wireless communication, the cover being a box-shaped cover which covers over a communication circuit device mounted on a circuit board (see, for example, Patent Document 1). By the technology, a compact antenna module having a small space required to be mounted can be provided for various electrical equipment and electronic equipment.

FIG. 7 is an exploded view of one conventional antenna module.

In the figure, the reference number 893 is one or plurality of communication circuit device(s) mounted on a surface of a circuit board 891. Further, the reference number 895 is a conductive pattern for signal which is formed on the surface of the circuit board 891 and connected to the communication circuit device 893. Further, the reference number 896 is a conductive pattern for grand which is formed on the surface of the circuit board 891.

Further, the reference number 811 is a box-shaped cover which covers over the surface of the communication circuit device 893 mounted on the surface of the circuit board 891 and the surrounding circuit board 891. Although the cover 811 is a member formed integrally by using ceramics, resins, and the like, an inner surface of the cover is coated with a conductive film for shielding (not shown) including a metal plating or a metal vapor deposition film. A conductive pattern 851 is selectively formed on an outer surface of the cover 811. Further, an antenna device 821 connected to the conductive pattern 851 is mounted on the outer surface of the cover 811.

The cover 811 is relatively moved with respect to the circuit board 891 as shown in an arrow of the figure, and mounted on the surface of the circuit board 891 so as to cover over the communication circuit device 893 and the surrounding. Thereby, the conductive pattern 851 is contacted with the conductive pattern for signal 895 on the surface of the circuit board 891 to conduct between them. The conductive film for shield formed on the entire inner surface of the cover 811 is contacted with the conductive pattern for grand 896 on the surface of the circuit board 891 to conduct between them. Then the conductive pattern 851 and the antenna device 821 connected with the communication circuit device 893 serve as an antenna.

Patent Document 1: Japanese Unexamined Patent Application Publication No. 2008-131489

SUMMARY

However, in the conventional antenna module, the distance between the conductive pattern 851 formed on the outer surface of the cover 811 and the conductive film for shield formed on the antenna device 821 and the inner surface of the cover 811 is difficult to set to be a certain value, and then an antenna having desired properties cannot be obtained. In general, the distance between the conductive pattern 851 and the conductive film for shield which serves as a grand surface in the antenna device 821 and the rear surface is required to be very small (for example, not more than 1 [mm]). If the thickness of the cover 811 formed by ceramics or resins becomes thin, the cover cannot have the sufficient strength. Further, accurately controlling the thickness to 1 [mm] or less is difficult.

An object of the present disclosure is to solve the problems of the conventional antenna module, and to simplify conformation and reduce size, to have sufficient strength, and to achieve the desired antenna properties and improved reliability.

To this end, the antenna module comprises a communication circuit for processing a radio signal; a shield member covering the communication circuit; a conductive strip electrically connected with the communication circuit; a dielectric integrated with the shield member and the conductive strip; and an antenna formed on an outer surface of the dielectric and electrically connected with the conductive strip.

In another antenna module, the conductive strip is arranged into a notch formed on the shield member without contacting with the shield member so that the conductive strip is generally disposed coplanar with the shield member.

In yet another antenna module, the conductive strip comprises a connection electrically connected with the antenna, and at least one of the connections is buried in the dielectric.

In yet another antenna module, the dielectric comprises a communication opening formed on a position corresponding to the connection, a connection end of the antenna is contacted with an edge of the communication opening, and the connection and the connection end are electrically connected via a communication pattern arranged on a side surface on the communication opening.

In yet another antenna module, the dielectric comprises an outer part positioned outside the shield member, an inner part positioned inside the shield member, and a connection part for connecting the outer part and the inner part.

According to the present disclosure, the conformation of the antenna can be simplified and downsized, and the antenna can have sufficient strength, and can exert the desired antenna properties and improved reliability.

BREIF DESCRIPTION OF DRAWINGS

FIG. 3A is a top view, FIG. 3B is a rear view, FIG. 3C is a front view, and FIG. 3D is a side view.

FIG. 4A is a cross-sectional view of the antenna module taken along the line A-A of FIG. 3A and FIG. 4B is a cross-sectional view of the antenna module taken along the line B-B of FIG. 3A.

DETAILED DESCRIPTION OF THE PREFERRED EMBODIMENTS

An embodiment will be described in detail below with reference to the drawings.

Figure 1:
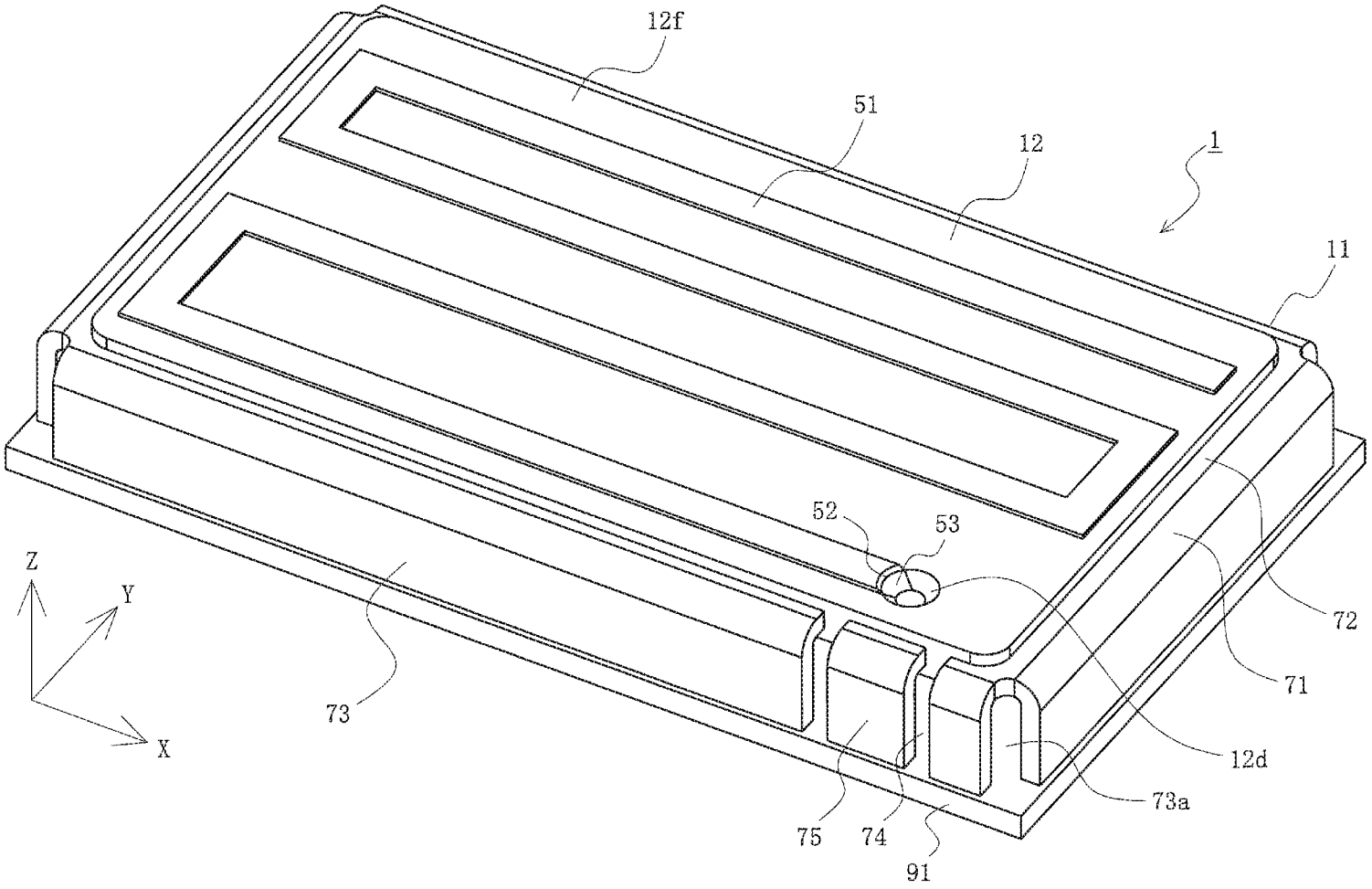
FIG. 1 is a perspective view of an antenna module in accordance with the first embodiment of the present disclosure.
Figure 2:
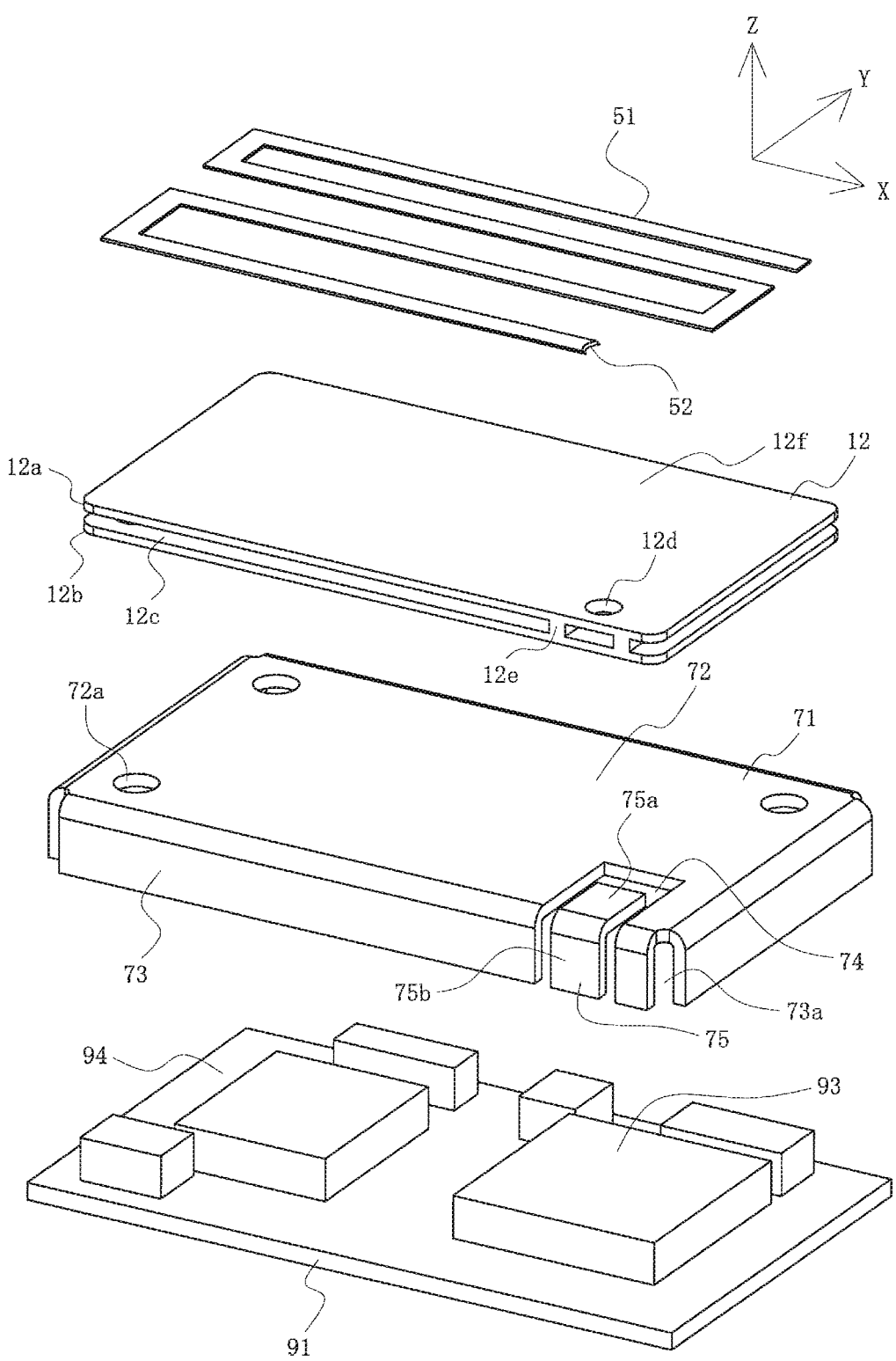
FIG. 2 is an exploded view of the antenna module in accordance with the first embodiment of the present disclosure.
Figures 3A, 3B, 3C, 3D:
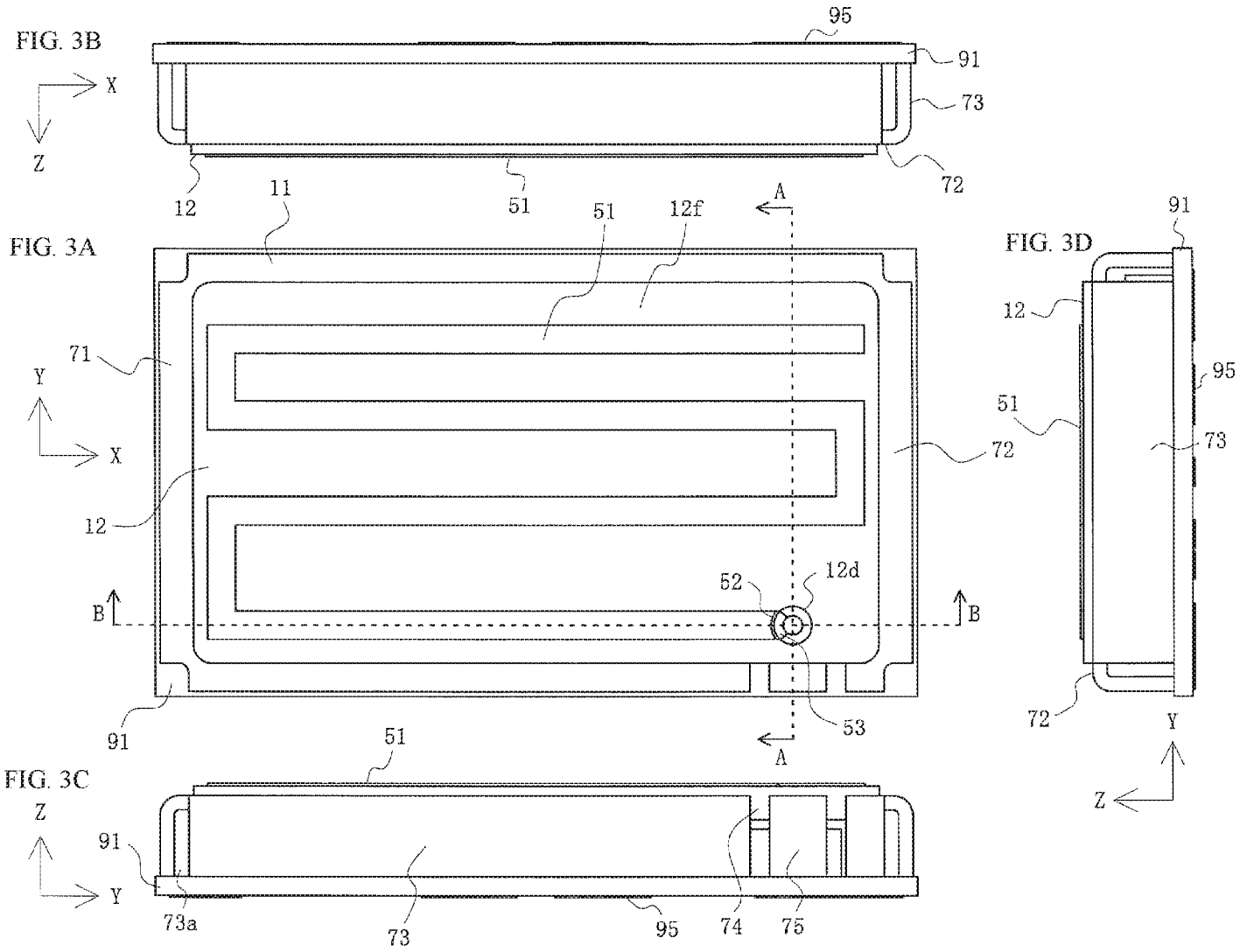
FIGS. 3A-3D are four-view drawings of the antenna module in accordance with the first embodiment of the present disclosure, where
Figure 4A:
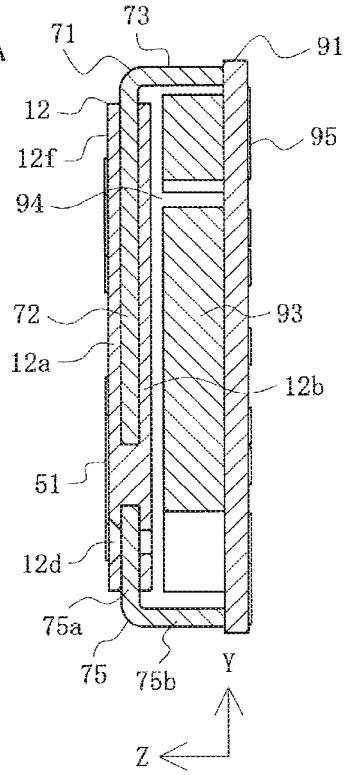
FIGS. 4A and 4B are cross-sectional views of the antenna module in accordance with the first embodiment of the present disclosure, where
Figure 4B:
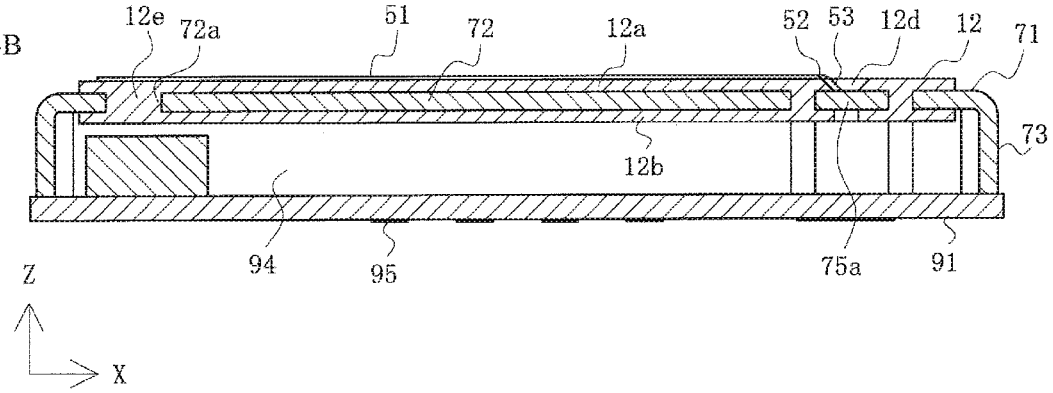

FIG. 1 is a perspective view of an antenna module in accordance with the first embodiment of the present disclosure. FIG. 2 is an exploded view of the antenna module in accordance with the first embodiment of the present disclosure. FIGS. 3A-3D are four-view drawings of the antenna module in accordance with the first embodiment of the present disclosure, where FIG. 3A is a top view, FIG. 3B is a rear view, FIG. 3C is a front view, and FIG. 3D is a side view. FIGS. 4A and 4B are cross-sectional views of the antenna module in accordance with the first embodiment of the present disclosure, where FIG. 4A is a cross-sectional view of the antenna module taken along the line A-A of FIG. 3A and FIG. 4B is a cross-sectional view of the antenna module taken along the line B-B of FIG. 3A.

In the FIGS., the reference number 1 is an antenna module of this embodiment. The antenna module is a module for wireless communication equipped with an antenna. The antenna module comprises a circuit device 93 arranged on a substrate 91; a communication circuit 94 for processing a radio signal; and a cover member 11 covering the communication circuit 94, i.e., positioned so as to cover the outside of the communication circuit 94, and wherein a conductive pattern 51 for acting as an antenna for transmitting and receiving a radio signal is arranged on the cover 11. The antenna module 1 is mounted in various industrial or household electrical equipment and electronic equipment. For example, the antenna module 1 is used for near field wireless communication such as Bluetooth®, but may be mounted in any type of equipment, or may be used for any type of wireless communication. Examples of the substrate 91 may include printed circuit boards used in electronic equipment, or ceramic substrates, flexible flat cables (FFC), or flexible printed circuit boards (FPC), etc., may be any type of substrates. Further, the circuit device 93 is an active device such as an IC chip, for example. The circuit device 93 may be a passive device such as a resistance, but may be any type of the circuit devices.

Note, in the present embodiment, expressions indicating the directions such as up, down, left, right, front, and back that are used to describe the configuration and operation of each part included in the antenna module 1 are relative and not absolute, and they are suitable when each part included in the antenna module 1 is in the position illustrated by the drawings; however, when the position of each part included in the antenna module 1 is changed, then they should be interpreted with changes corresponding to the changes of the positions.

In the example shown in the figure, the substrate 91 is a planer member having general rectangle shape. The cover member 11 is a box-shaped or container-shaped member having a general cuboid having an opened lower surface. The cover member 11 is mounted on the substrate 91 so as to cover almost entirely all of the front surface of the substrate 91 (surface on the side of the positive area in Z axis). One or plurality of the circuit device(s) 93 is/are mounted on the surface of the substrate 91, and a conductive line (not shown) electrically connected to the circuit device(s) 93 is formed, which are components of the communication circuit 94. A connection pad 95 as one or plurality of the connection(s) is formed on the rear surface (surface on the side of the negative area in Z axis) of the substrate 91. The connection pad 95 is used for electrically connecting the antenna module 1 with each parts of the devices to be mounted.

The cover member 11 comprises a shell 71 as the shield member being composed of a conductive metal such as an aluminum alloy or a copper alloy, a dielectric 12 being composed of a dielectric material such as a resin which covers at least part of the shell 71, and a conductive pattern 51 being composed of a conductive metal and arranged on the surface of the dielectric 12. For convenience, the dielectric 12 is independently shown in FIG. 2; however, the dielectric 12 is a member formed with the shell 71 integrally by insert molding (overmolding) in which the shell 71 is charged in a mold for the molding and then the dielectric material such as a synthetic resin is added in the mold. Therefore, in fact, the dielectric 12 is not presented as a single body having the shape as shown in FIG. 2. Further, since the dielectric 12 is a member formed with the shell 71 integrally by insert molding, even if an external force is applied to the dielectric 12, the components of the dielectric 12 are not delaminated, or the shell 77 or the conductive strip 75 is not removed.

In the example as shown in the figure, the shell 71 is a box-shaped or container-shaped member having a general cuboid shape having an opened lower surface (surface on the side of the negative area in Z axis) having a top panel 72 which is a planer member having general rectangle shape and four side panels 73 which is a planer member having general rectangle shape extending downward (in the negative direction in Z axis) from each for side line of the top panel 72, and the member is formed by bending process of a metal plate. The top end of each side panel 73 is connected integrally with the side line of the top panel 72. In the example as shown in the figure, the adjacent side panels 73 are spaced apart from each other, and thereby a corner aperture 73*a* is formed. If needed, the corner aperture 73*a* can be eliminated by coming into contact with the adjacent side panels 73 or bending them. In the top panel 72, one or a plurality of opening(s) 72*a* is/are formed. The opening 72*a* is a through-hole which is penetrates through the top panel 72 in the thickness direction. When the dielectric 12 is formed, a connection part 12*e* connecting between an upper panel 12*a* and a lower panel 12*b* of the dielectric 12 is formed in the opening by passing the resin as the raw material through the opening.

A notch 74 is formed on the shell 71. A conductive strip 75 is arranged into the notch 74 without contacting with the shield member 71. In the example shown in the figure, the notch 74 and the conductive strip 75 are arranged at a site adjacent to the one end of the long side line (the left end in FIG. 3B) of the rectangle shape of the top panel 72 in the planar view. The notch 74 is formed so as to extend from a site near the side line corresponding to the long line of the top panel 72 to the side line and to extend from the side line to the bottom end of the side panel 73, and to open in the bottom end. The conductive strip 75 is a member being composed of a conductive metal having an elongated planer shape and bended generally at right angle. The contour of the conductive strip 75 is a similar shape to the shape of the notch 74, and the dimension of the contour is formed so as to be smaller than that of the notch 74. Further, the conductive strip 75 has an upper part 75*a* which is generally disposed coplanar with the top panel 72 and a side part 75*b* which is generally disposed coplanar with the side panel 73. The connection part 12*e* of the dielectric 12 is also formed into the notch 74 surrounding the upper part 75*a*. Desirably, the conductive strip 75 is a member produced by cutting a part of the shell 71 by processing, for example, punching the shell 71. The notch 74 is a mark obtained by cutting the conductive strip 75. The conductive strip 75 and the shell 71 is formed integrally with the dielectric 12 by insert molding. The upper part 75*a* is a part functioning as the connection in which at least one of the upper parts 75*a* is buried in the dielectric 12 and electrically connected to the conductive pattern 51.

Further, the dielectric 12 comprises an upper panel 12*a* as the outer part having planer shape which is positioned outside the shell 71 and covers almost entirely all of the upper surface of the top panel 72, a lower panel 12*b* as the inner part having planer shape which is positioned inside the shell 71 and covers almost entirely all of the lower surface of the top panel 72, a connection part 12*e* connecting between the upper panel 12*a* and the lower panel 12*b*, and a housing recess 12*c* which is a space between the panel 12*a* and the lower panel 12*b* for housing the top panel 72. A communication opening 12*d* is formed which penetrates through the upper panel 12*a* in the thickness direction on the corresponding site of the upper part 75*a* of the conductive strip 75 on the upper panel 12*a*. The communication opening 12*d* is a tapered opening with decreasing the diameter downwardly, is positioned over the upper part 75*a* of the conductive strip 75, and is opened toward the upper surface 12*f* and the lower surface of the upper panel 12*a*. Therefore, the upper surface of the upper part 75*a* is exposed to the outside of the cover member 11. In the example as shown in the figure, a thorough-hole is formed on the lower panel 12*b* at a site corresponding to the communication opening 12*d*, but the thorough-hole may be suitably omitted.

Then a conductive pattern 51 is arranged on the outer surface of the dielectric 12, i.e., the upper surface 12*f* of the upper panel 12*a*. In the example as shown in the figure, the conductive pattern 51 is a conductive thin plate having an elongated band shape formed so as to be a serpentine shape in the planar view. The one end of the conductive pattern 51 is contacted with the edge of the communication opening 12*d* as the connection end 52, and the connection end 52 is electrically connected with the upper surface of the upper part 75*a* of the conductive strip 75 via the communication pattern 53 arranged on the side surface of the communication opening 12*d*. The conductive pattern 51 is a thin plate or a thin membrane made by a conductive metal such as a copper alloy, and serves as the antenna in the antenna module 1.

The conductive pattern 51 is formed on the upper surface 12*f* of the upper panel 12*a* by a technology for forming a circuit on a member being composed of a conductive material. More specifically, a conductive design corresponding to the conductive pattern 51 and the communication pattern 53 is formed by applying and sintering a conductive material such as a silver paste on the upper surface 12*f* of the upper panel 12*a* of the dielectric 12 formed integrally with the shell 71 and the conductive strip 75 by using a technology such as an ink jet technology. Next, a conductive metal coating such as copper coating is formed on the conductive design by using an electrolytic plating (electroplating). Thereby, the conductive pattern 51 and the communication pattern 53 can be obtained. When the electrolytic plating is performed, the conductive design can be used as a cathode by conducting the conductive design via the conductive strip 75.

Note that the method for forming the conductive pattern 51 is not limited to the method, but any method can be used. For example, the conductive pattern 51 can also be formed by adhering a thin plate or thin film having a certain pattern made by a metal formed on, e.g., FPC paste on the upper surface 12*f* of the upper panel 12*a*.

In the example as shown in the figure, although the thickness (dimension in Z axis direction) is about 0.03 [mm], the thickness of the upper panel 12*a* is about 0.1 [mm], the thickness of the top panel 72 is about 0.15 [mm], and the thickness of the lower panel 12*b* is about 0.1 [mm], these values may be suitably changed depending on the needs including the adjustment of the antenna properties.

Then the cover member 11 is, as shown in the figure, placed on the surface of the substrate 91. For example, the cover member 11 is fixed on the surface of the substrate 91 by soldering the lower end of the side panel 73 of the shell 71 on a connection pad (not shown) of the surface of the substrate 91. Thereby, the communication circuit 94 including the communication circuit 93 is accommodated inside of the box-shaped or container-shaped shell 71, as shown in FIGS. 4A and 4B. Further, the shell 71 covers almost entirely all of the surface of the substrate 91. Then at least part of the lower end in the side panel 73 of the shell 71 is contacted with a conductive line for grand (not shown) formed on the surface of the substrate 91 to conduct them. The lower end of the side part 75*b* of the conductive strip 75 is a conductive line for signal (not shown) formed on the surface of the substrate 91, and is connected to a conductive line contained in the communication circuit 94. Thereby, since the conductive pattern 51 is connected with the communication circuit 94 via the communication pattern 53 and the conductive strip 75, the conductive pattern 51 serves as the antenna and can transfer and receive a radio signal. As shown in FIGS. 4A and 4B, desirably, there are gaps between all circuit devices 93 and the shell 71 or the dielectric 12.

As such, in this embodiment, the antenna module 1 comprises the communication circuit 94 for processing a radio signal; the shell 71 covering the communication circuit 94; the conductive strip 75 electrically connected with the communication circuit 94; the dielectric 12 integrated with the shell 71 and the conductive strip 75; and the conductive pattern 51 formed on the outer surface 12*f* of the dielectric 12 and electrically connected with the conductive strip 75.

Thereby, the conformation of the antenna module 1 can be simplified and downsized, and the antenna can have sufficient strength, and can achieve the desired antenna properties and improved reliability.

Further, the conductive strip 75 is arranged into the notch 74 formed on the shell 71 without contacting with the shell 71 so that the conductive strip 75 is generally disposed coplanar with the shell 71. Therefore, the dielectric 12 can form integrally with the shell 71 and the conductive strip 75 without increasing the thickness of the dielectric 12.

Further, the conductive strip 75 comprises the upper part 75*a* electrically connected with the conductive pattern 51, and at least one of the upper parts 75*a* is buried in the dielectric 12. Therefore, the conductive pattern 51 formed on the upper surface 12*f* of the dielectric 12 and the conductive strip 75 can be electrically connected reliably and easily.

Further, the dielectric 12 comprises the communication opening 12*d* formed on a position corresponding to the upper part 75*a*, the connection end 52 of the conductive pattern 51 is contacted with the edge of the communication opening 12*d*, and the upper part 75*a* and the connection end 52 are electrically connected via the communication pattern 53 arranged on the side surface on the communication opening 12*d*. Therefore, the conductive pattern 51 formed on the upper surface 12*f* of the dielectric 12 and the upper part 75*a* buried in the dielectric 12 can be electrically connected reliably and easily.

Further, the dielectric 12 comprises the outer part 12*a* positioned outside the shell 71, the inner part 12*b* positioned inside the shell 71, and the connection part 12*e* for connecting the outer part 12*a* and the inner part 12*b*. Therefore, even if the shell 71 and the dielectric 12 formed integrally with the shell 71 become thinner, the sufficient strength can be maintained.

Next a second embodiment will be described. Note that the description of objects having the same structures as those of the first embodiment will be omitted by being denoted by the same reference numbers. Furthermore, the description of operations and effects that are the same as those of the first embodiment will be omitted.

Figure 5:
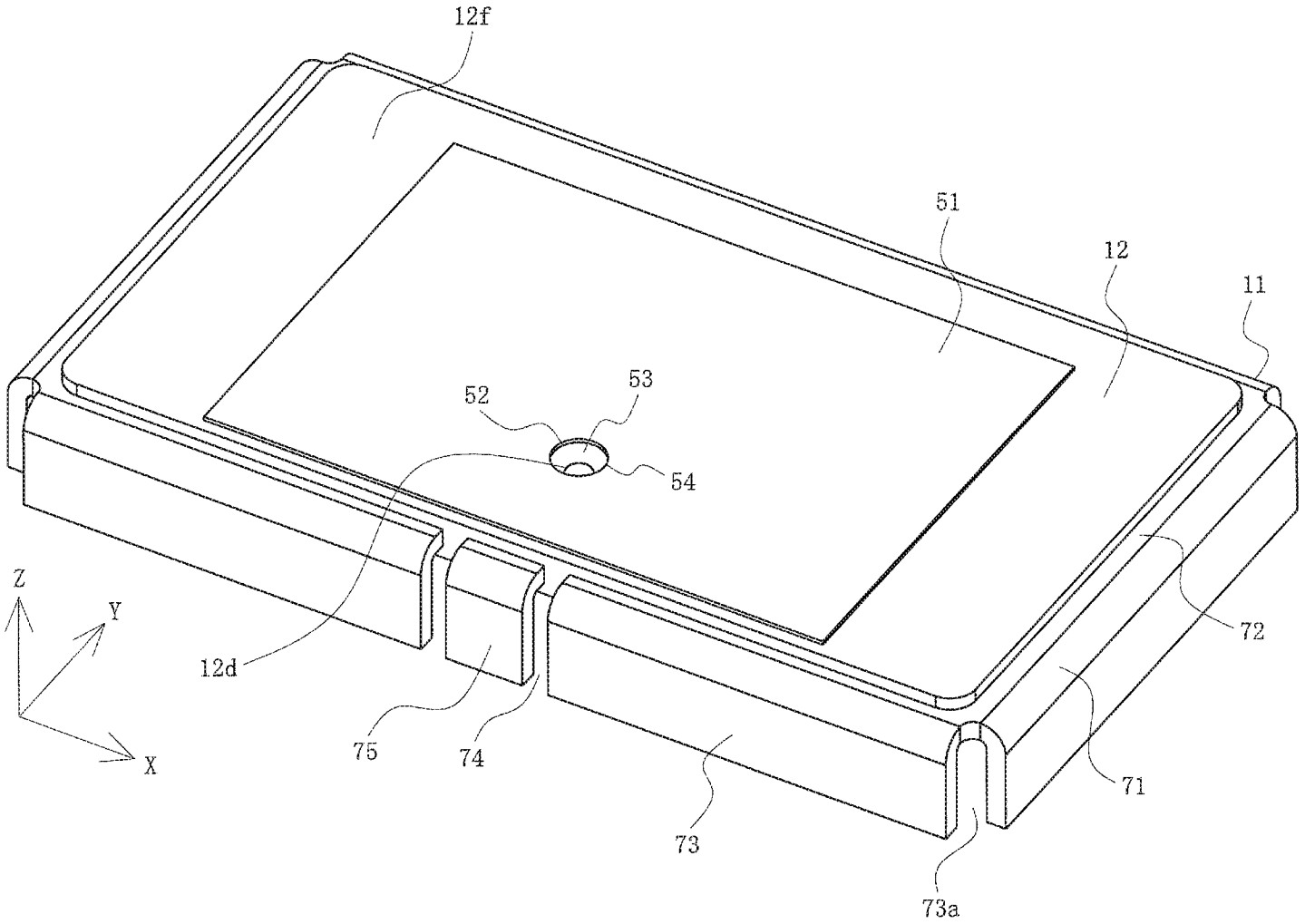
FIG. 5 is a perspective view of the first example of a cover member in accordance with the second embodiment of the present disclosure.
Figure 6:
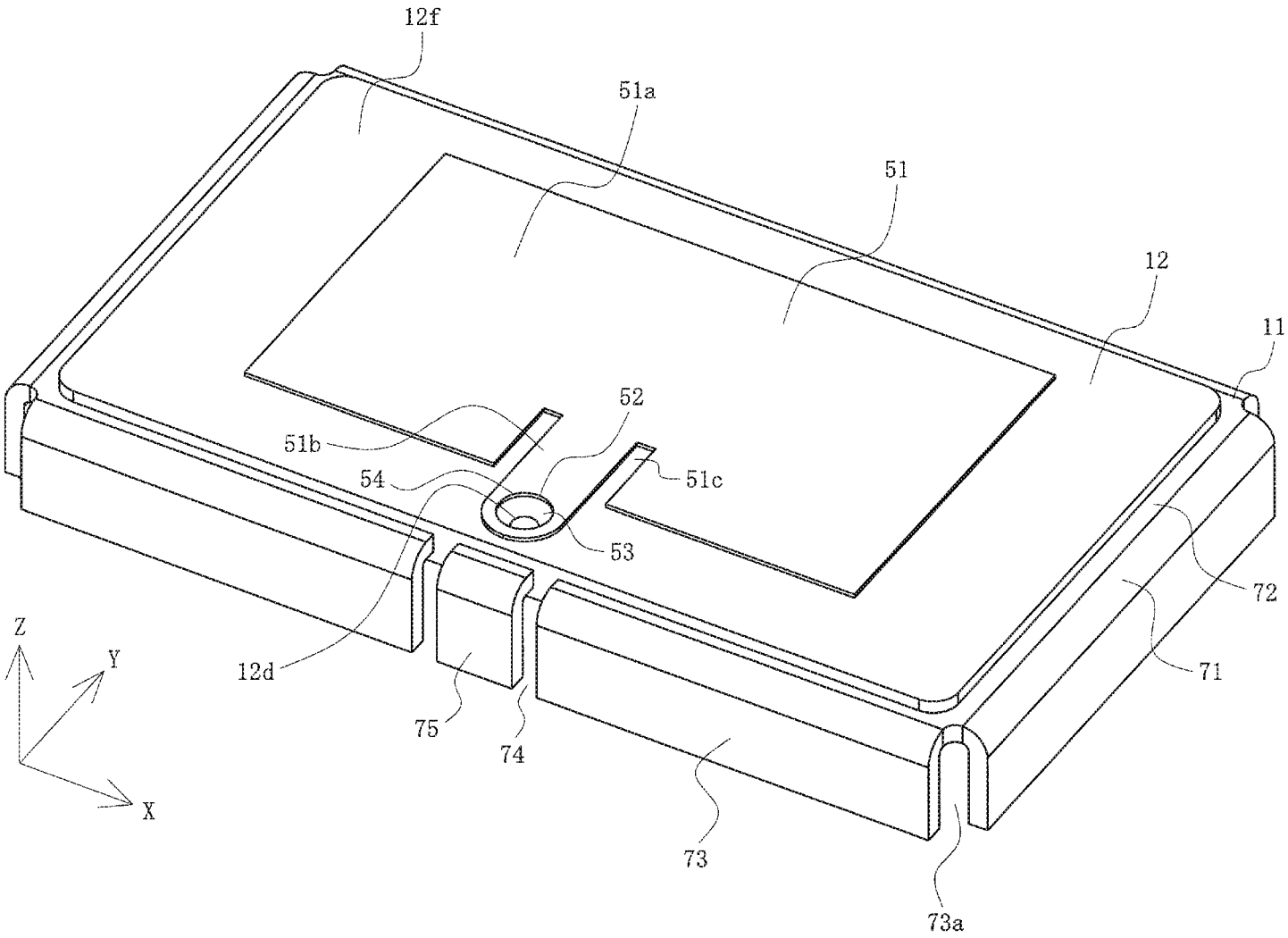
FIG. 6 is a perspective view of the second example of a cover member in accordance with the second embodiment of the present disclosure.
Figure 7:
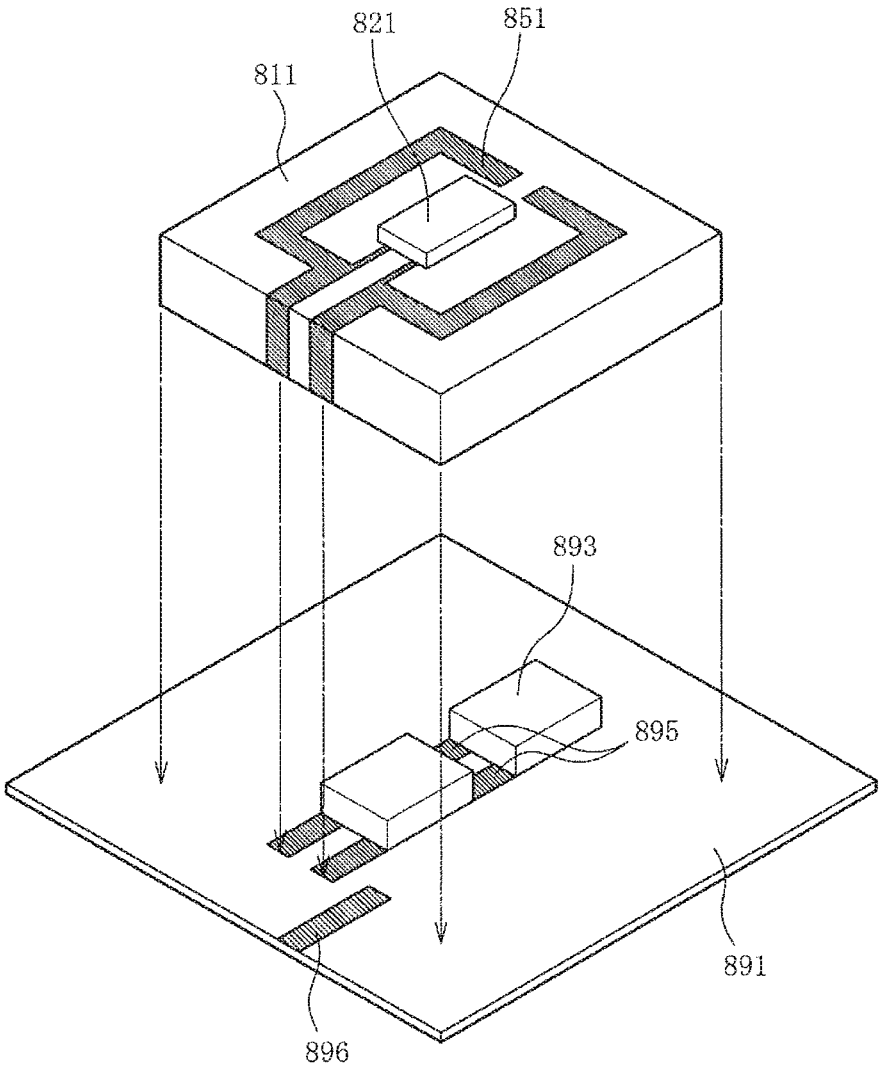
FIG. 7 is an exploded view of one conventional antenna module.

FIG. 5 is a perspective view of the first example of a cover member in accordance with the second embodiment of the present disclosure. FIG. 6 is a perspective view of the second example of a cover member in accordance with the second embodiment of the present disclosure.

In the first embodiment as described above, the conductive pattern 51 contained in the cover member 11 is a conductive thin plate having an elongated band shape formed so as to be a serpentine shape in the planar view. In contrast, in this embodiment, the conductive pattern 51 contained in the cover member 11 as shown in the first example of FIG. 5 is one conductive thin plate having general rectangle shape in the planar view.

Further, in the first embodiment as described above, the notch 74 and the conductive strip 75 are arranged at a site adjacent to the one end of the long side line of the rectangle shape of the top panel 72 in the planar view. In contrast, the notch 74 and the conductive strip 75 according to this embodiment, as shown in the first example of FIG. 5, are arranged at a site adjacent to the center of the one long side line of the rectangle shape of the top panel 72 in the planar view.

Then the communication opening 12*d* is formed on the upper panel 12*a* of the dielectric 12 positioned above the upper part 75*a* of the conductive strip 75, and the communication opening 54 is formed at a position corresponding to the communication opening 12*a* in the conductive pattern 51. The connection opening 54 is a through-hole having circular shape formed near the center of the one long line of the rectangle shape of the conductive pattern 51 and at a position near the long line.

Then the diameter of the connection opening 54 is almost the same as that of the top end of the communication opening 12*d* being tapered. The circular edge of the connection opening 54 is the connection end 52 of the conduction pattern 51. In this embodiment, since the connection end 52 is the circular edge of the connection opening 54, the communication pattern 53 which is electrically connecting the connection end 52 and the upper surface of the upper part 75*a* of the conductive strip 75 is formed over the entire side surface of the communication opening 12*d* having conical shape.

Note, since the other points of the configuration of the cover member 11 in the first example are the same as the first embodiment, the descriptions thereof are omitted.

Next the cover member 11 shown as the second example in FIG. 6 will be described.

The conductive pattern 51 included on the cover member 11 is one conductive thin plate, and the conductive pattern 51 comprises the main body 51*a* having general rectangle shape in the planar view, the notch 51*c* formed on the main body 51*a*, and the connection strip 51*b* arranged inside the notch 51*c*. The notch 51*c* is formed near the center of one long line of the rectangle shape of the main body 51*a* and at a position near the long line in the planar view. Then the notch 51*c* is formed so as to extend from a site near the long line of the main body 51*a* to the long line, and to open in the long line. Further, the connection strip 51*b* has an elongated rectangle shape extending to a direction same as the notch 51*c*, the base end (end on the side of the positive area in Y axis) is connected integrally with the main body 51*a* in the back end (end on the side of the positive area in Y axis), and the end (end on the side of the negative area in Y axis) is protruding to the outside of the notch 51*c*. The circular connection opening 54 is formed near the tip of the connection strip 51*b*.

Note, since the other points of the configuration of the cover member 11 in the second example are the same as the first embodiment, the descriptions thereof are omitted.

Note, since the other points of the configuration of the antenna module 1 according to this embodiment are the same as the first embodiment, the descriptions thereof are omitted.

Note that the present disclosure according to the present specification is only one example, and thus any appropriate change that preserves the gist of the present disclosure and can easily be conceived by a person skilled in the art is within the scope of the present disclosure. The widths, thicknesses, and shapes of the portions illustrated in the drawing are illustrated schematically and are not intended to limit the interpretation of the present disclosure.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The invention claimed is:

1. An antenna module, comprising:

a communication circuit for processing a radio signal, the communication circuit comprising a substrate having a surface and at least one circuit device mounted on the surface of the substrate;

a shield member mounted to the surface of the substrate and covering a substantial portion of the surface of the substrate;

a conductive strip electrically connected with the communication circuit and mounted to the surface of the substrate;

a dielectric integrated with the shield member and the conductive strip; and an antenna formed on an outer surface of the dielectric and electrically connected with the conductive strip.

2. The antenna module according to claim 1, wherein the conductive strip is arranged into a notch formed on the shield member without contacting with the shield member so that the conductive strip is generally disposed coplanar with the shield member.

3. The antenna module according to claim 1, wherein the conductive strip comprises a connection electrically connected with the antenna, and at least one of the connections is buried in the dielectric.

4. The antenna module according to claim 3, wherein the dielectric comprises a communication opening formed on a position corresponding to the connection, a connection end of the antenna is contacted with an edge of the communication opening, and the connection and the connection end are electrically connected via a communication pattern arranged on a side surface on the communication opening.

5. The antenna module according to claim 1, wherein the dielectric comprises an outer part positioned outside the shield member, an inner part positioned inside the shield member, and a connection part for connecting the outer part and the inner part.

6. An antenna module, comprising:

a communication circuit for processing a radio signal;

a shield member covering the communication circuit;

a conductive strip electrically connected with the communication circuit;

a dielectric integrated with the shield member and the conductive strip; and an antenna formed on an outer surface of the dielectric and electrically connected with the conductive strip, wherein the conductive strip is arranged into a notch formed on the shield member without contacting with the shield member so that the conductive strip is generally disposed coplanar with the shield member.

7. An antenna module, comprising:

a communication circuit for processing a radio signal;

a shield member covering the communication circuit;

a conductive strip electrically connected with the communication circuit;

a dielectric integrated with the shield member and the conductive strip; and an antenna formed on an outer surface of the dielectric and electrically connected with the conductive strip, wherein the conductive strip comprises a connection electrically connected with the antenna, and at least one of the connections is buried in the dielectric.

8. The antenna module according to claim 7, wherein the dielectric comprises a communication opening formed on a position corresponding to the connection, a connection end of the antenna is contacted with an edge of the communication opening, and the connection and the connection end are electrically connected via a communication pattern arranged on a side surface on the communication opening.

9. An antenna module, comprising:

a communication circuit for processing a radio signal;

a shield member covering the communication circuit;

a conductive strip electrically connected with the communication circuit;

a dielectric integrated with the shield member and the conductive strip; and an antenna formed on an outer surface of the dielectric and electrically connected with the conductive strip, wherein the dielectric comprises an outer part positioned outside the shield member, an inner part positioned inside the shield member, and a connection part for connecting the outer part and the inner part.

* * * * *